US008846168B2

(12) United States Patent
Lee et al.

(10) Patent No.: US 8,846,168 B2
(45) Date of Patent: Sep. 30, 2014

(54) THERMAL TRANSFER FILM

(71) Applicants: Jung Hyo Lee, Uiwang-si (KR); Hyoung Tae Lim, Uiwang-si (KR); Kyoung Ku Kang, Uiwang-si (KR); Si Kyun Park, Uiwang-si (KR)

(72) Inventors: Jung Hyo Lee, Uiwang-si (KR); Hyoung Tae Lim, Uiwang-si (KR); Kyoung Ku Kang, Uiwang-si (KR); Si Kyun Park, Uiwang-si (KR)

(73) Assignee: Cheil Industries, Inc., Gumi-si, Kyeongsangbuk-do (KR)

( * ) Notice: Subject to any disclaimer, the term of this patent is extended or adjusted under 35 U.S.C. 154(b) by 0 days.

(21) Appl. No.: 13/927,291

(22) Filed: Jun. 26, 2013

(65) Prior Publication Data

US 2013/0287974 A1 Oct. 31, 2013

Related U.S. Application Data

(63) Continuation of application No. PCT/KR2011/005921, filed on Aug. 12, 2011.

(30) Foreign Application Priority Data

Dec. 27, 2010 (KR) ..... 10-2010-0136075
Dec. 30, 2010 (KR) ..... 10-2010-0139674

(51) Int. Cl.
*B41M 5/46* (2006.01)
*B41M 5/382* (2006.01)

(52) U.S. Cl.
CPC ..... *B41M 5/465* (2013.01); *B41M 5/38242* (2013.01)
USPC ..... 428/32.81; 428/32.64

(58) Field of Classification Search
CPC ..... B41M 5/465; B41M 5/38242
USPC ..... 428/32.64, 32.81
See application file for complete search history.

(56) References Cited

U.S. PATENT DOCUMENTS

| | | | | |
|---|---|---|---|---|
| 7,112,396 | B2 | 9/2006 | Miyake et al. | |
| 7,517,833 | B2 | 4/2009 | Fukui et al. | |
| 7,678,526 | B2 * | 3/2010 | Wright et al. | 430/200 |
| 2005/0153229 | A1 | 7/2005 | Miyake et al. | |
| 2005/0186366 | A1 | 8/2005 | Kim et al. | |
| 2006/0073280 | A1 | 4/2006 | Bauer et al. | |
| 2008/0003519 | A1 | 1/2008 | Felder et al. | |
| 2008/0152847 | A1 | 6/2008 | Fukui et al. | |
| 2009/0047596 | A1 | 2/2009 | Felder et al. | |
| 2009/0078366 | A1 | 3/2009 | Endo et al. | |

FOREIGN PATENT DOCUMENTS

| | | | |
|---|---|---|---|
| JP | 2005-238825 | A | 9/2005 |
| JP | 2006-503137 | A | 1/2006 |
| KR | 10 2000-0000656 | A | 1/2000 |
| KR | 10-0645406 | B1 | 6/2006 |
| KR | 10 2007-0067725 | A | 6/2007 |
| KR | 10 2007-0084022 | A | 8/2007 |
| KR | 10 2008-0046259 | A | 5/2008 |
| TW | 1357858 | B | 2/2012 |

OTHER PUBLICATIONS

Korean Office Action in KR 10-2010-0136075, dated Feb. 27, 2013 (Lee, et al.).

(Continued)

*Primary Examiner* — Bruce H Hess
(74) *Attorney, Agent, or Firm* — Lee & Morse, P.C.

(57) ABSTRACT

A thermal transfer film includes a light-to-heat conversion layer including a binder and a dye.

22 Claims, 2 Drawing Sheets

(56) References Cited

OTHER PUBLICATIONS

Korean Office Action in KR 10-2010-0139674, dated Apr. 1, 2013 (Lee, et al.).

International Search Report in PCT/KR2011/005921, dated Mar. 27, 2012 (Lee, et al.).

Taiwanese Office Action in TW 100129583, dated Aug. 28, 2013, with English Translation (Lee, et al.).

* cited by examiner

THERMAL TRANSFER FILM

CROSS-REFERENCE TO RELATED APPLICATIONS

This application is a continuation of pending International Application No. PCT/KR2011/005921, entitled "THERMAL TRANSFER FILM," which was filed on Aug. 12, 2011, the entire contents of which are hereby incorporated by reference.

This application claims the benefit of and priority under 35 U.S.C. §119 to Korean Patent Application No. 10-2010-0136075, filed on Dec. 27, 2010, in the Korean Intellectual Property Office, and entitled: "THERMAL TRANSFER FILM," and Korean Patent Application No. 10-2010-0139674, filed on Dec. 30, 2010, in the Korean Intellectual Property Office, and entitled: "THERMAL TRANSFER FILM," each of which is incorporated by reference herein in its entirety.

BACKGROUND

1. Field

Embodiments relate to a thermal transfer film.

2. Description of the Related Art

In recent years, there has been an increasing demand for thin, high-performance products in various fields, including optical, display, semiconductor, and biotechnology industries. In response to this demand, interconnections or functional thin film layers constituting components for the products are required to have smaller and more uniform patterns.

SUMMARY

Embodiments are directed to a thermal transfer film, including a light-to-heat conversion layer including a dye and a binder.

The thermal transfer film may have an optical density variation greater than or equal to 0 but smaller than 1.

The thermal transfer film may have an optical density variation greater than or equal to 0 but smaller than 0.5.

The dye may include a near-infrared absorbing dye.

The near-infrared absorbing dye may absorb light in the wavelength range of 700 nm to 1,200 nm.

The dye may include at least one of a diimmonium dye, a metal complex dye, a naphthalocyanine dye, a phthalocyanine dye, a polymethine dye, an anthraquinone dye, a porphyrin dye, and a metal complex type cyanine dye.

50% or more by weight of the binder may be thermally decomposed at 450° C.

The binder may include at least one of a phenolic resin, a polyvinyl butyral resin, a polyvinyl acetate resin, a polyvinyl acetal resin, a polyvinylidene chloride resin, a polyacrylate resin, cellulose ether resin, a cellulose ester resin, a nitrocellulose resin, a polycarbonate resin, a polyalkyl (meth)acrylate resin, an epoxy (meth)acrylate resin, an epoxy resin, a urethane resin, an ester resin, an ether resin, an alkyd resin, a spiroacetal resin, a polybutadiene resin, a polythiol-polyene resin, a (meth)acrylate resin of a polyhydric alcohol, and a (meth)acrylate resin of a polyfunctional acrylic resin.

The dye and the binder may be present in amounts of 0.1 to 10% by weight and 90 to 99.9% by weight, respectively, based on the solids content of the light-to-heat conversion layer.

The light-to-heat conversion layer may further include a pigment and may have an optical density variation greater than or equal to 0 but smaller than 1 at a wavelength at which the dye absorbs in the range of 700 nm to 1,200 nm.

The optical density variation may be greater than or equal to 0 but smaller than 0.1.

The light-to-heat conversion layer may have optical density values of 1.0 to 5.0 at a wavelength at which the dye absorbs in the range of 700 nm to 1,200 nm.

The pigment and the dye may be present in a total amount of 1 to 50% by weight, based on the solids content of the light-to-heat conversion layer.

The pigment and the dye may be present in a weight ratio of 1:0.1 to 1:9.

The pigment and the dye may be present in amounts of 0.5 to 29.5% by weight, respectively, based on the solids content of the light-to-heat conversion layer.

The pigment may include at least one of a carbon black pigment, a metal oxide pigment, a metal sulfide pigment, and a graphite pigment.

The binder may include at least one of a UV curable resin and a polyfunctional monomer.

The light-to-heat conversion layer may have a thickness of 1 to 10 μm.

The light-to-heat conversion layer may further include at least one additive of an ionic liquid, a photoinitiator, and a dispersant.

The light-to-heat conversion layer may include the ionic liquid, and the ionic liquid may include at least one anion selected from the group of $Br^-$, $Cl^-$, $I^-$, $BF_4^-$, $PF_6^-$, $ClO_4^-$, $NO_3^-$, $AlCl_4^-$, $Al_2Cl_7^-$, $AsF_6^-$, $SbF_6^-$, $CH_3COO^-$, $CF_3COO^-$, $CH_3SO_3^-$, $C_2H_5SO_3^-$, $CH_3SO_4^-$, $C_2H_5SO_4^-$, $CF_3SO_3^-$, $(CF_3SO_2)_2N^-$, $(CF_3SO_2)_3C^-$, $(CF_3CF_2SO_2)_2N^-$, $C_4F_9SO_3^-$, $C_3F_7COO^-$, and $(CF_3SO_2)(CF_3CO)N^-$, and at least one cation selected from the group of a substituted or unsubstituted $C_4$-$C_{20}$ imidazolium, a substituted or unsubstituted $C_4$-$C_{20}$ pyridinium cation, a $C_1$-$C_{20}$ aliphatic ammonium cation, and a $C_6$-$C_{20}$ alicyclic ammonium cation.

The light-to-heat conversion layer may include the ionic liquid, and the ionic liquid may be present in an amount of 0.1 to 70 parts by weight, based on 100 parts by weight (solids content) of the light-to-heat conversion layer.

Embodiments are also directed to a thermal transfer film, including a base film, a light-to-heat conversion layer according to an embodiment laminated on the base film, and a transfer layer laminated on the light-to-heat conversion layer.

Embodiments are also directed to a thermal transfer film, including a base film, a light-to-heat conversion layer according to an embodiment laminated on the base film, an interlayer laminated on the light-to-heat conversion layer, and a transfer layer laminated on the interlayer.

BRIEF DESCRIPTION OF DRAWINGS

Features will become apparent to those of skill in the art by describing in detail exemplary embodiments with reference to the attached drawings in which.

DETAILED DESCRIPTION

Example embodiments will now be described more fully hereinafter; however, they may be embodied in different forms and should not be construed as limited to the embodiments set forth herein. Rather, these embodiments are provided so that this disclosure will be thorough and complete, and will fully convey example implementations to those skilled in the art.

Figure 1:
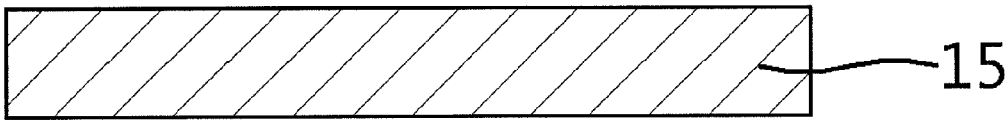
FIGS. 1 to 3 illustrate sectional views of thermal transfer films according to the embodiments.

FIG. 1 illustrates a sectional view of a thermal transfer film according to an embodiment. In an example embodiment, a thermal transfer film includes a light-to-heat conversion layer including a dye and a binder. The light-to-heat conversion layer of the thermal transfer film may absorb light in the infrared, visible, and/or UV region of the electromagnetic spectrum or light in a specific wavelength range to convert the light to theimal energy.

The thermal transfer film may have an optical density (OD) variation greater than or equal to 0 but smaller than 1.

The OD variation is a criterion for determining whether the distribution of OD values of the light-to-heat conversion layer is uniform, and represents the degree of dispersion of measured OD values. The OD variation may be determined by irradiating light of a wavelength of 700 nm to 1,200 nm where the dye absorbs onto the light-to-heat conversion layer having a uniform coating thickness (e.g., 1 to 10 μm), measuring the OD values of the light-to-heat conversion layer several times (e.g., ten times or more), and calculating the difference between the maximum and minimum OD values.

A smaller OD variation of the light-to-heat conversion layer at a particular wavelength means more uniform OD values of the light-to-heat conversion layer. In such a case, the light-to-heat conversion layer may provide higher transfer efficiency.

According to an example embodiment, the light-to-heat conversion layer may have an OD variation greater than or equal to 0 but smaller than 1 at a wavelength at which the dye absorbs in the range of 700 nm to 1,200 nm. In an implementation, the OD variation may be greater than or equal to 0 but smaller than 0.5, e.g., from 0 to 0.1. The wavelength may be from 750 nm to 1,200 nm.

In an example embodiment, the light-to-heat conversion layer may include a near-infrared absorbing dye. The presence of the near-infrared absorbing dye in the light-to-heat conversion layer may help ensure efficient transfer to a receptor and good appearance of the light-to-heat conversion layer.

When the near-infrared absorbing dye is included in the light-to-heat conversion layer, the OD values of the light-to-heat conversion layer may be from 1.0 to 1.5 at a wavelength of 700 nm to 1,200 nm. Within this OD range, light energy may be more efficiently converted to thermal energy, which may swell the binder and facilitate the transfer of a transfer material to a receptor.

The light-to-heat conversion layer may have OD values of 1.0 to 5.0 at a wavelength of 700 nm to 1,200 nm where the dye absorbs. Within the range defined above, swelling of the binder may place and facilitate the transfer of a transfer material. The light-to-heat conversion layer may have OD values of, e.g., 1.0 to 2.0.

In an example embodiment, the light-to-heat conversion layer may include a pigment, the binder, and the dye. The OD variation of the light-to-heat conversion layer including both the pigment and the dye may be smaller than that of the light-to-heat conversion layer including the dye only.

The OD variation may be determined by irradiating light of a wavelength of 700 nm to 1,200 nm where the dye absorbs onto the light-to-heat conversion layer having a uniform coating thickness (e.g., 1 to 10 μm), measuring the OD values of the light-to-heat conversion layer several times (e.g., ten times or more), and calculating the difference between the maximum and minimum OD values.

The OD variation may be greater than or equal to 0 but smaller than 1. The OD variation may be greater than or equal to 0 but smaller than 0.1, e.g., from 0.02 to 0.08. The wavelength may be from 750 nm to 1,200 nm.

The light-to-heat conversion layer may have OD values of 1.0 to 5.0, which is a target range for thermal transfer, at a wavelength of 700 nm to 1,200 nm where the dye absorbs. When a voltage is applied to the light-to-heat conversion layer having OD values within the range defined above, swelling of the binder may take place and facilitate the transfer of a transfer material. In an implementation, the OD values of the light-to-heat conversion layer may be between 1.0 and 2.0.

In a general light-to-heat conversion layer including a pigment only, low dispersion efficiency of the pigment may result in the formation of spots and may result in nonuniform OD values for the light-to-heat conversion layer. In contrast, in the present example embodiment in which the dye and the pigment are included as light-to-heat conversion materials in the light-to-heat conversion layer, OD variation may be reduced, i.e., there may be more uniform OD values of the light-to-heat conversion layer, which may allow the light-to-heat conversion layer to have good appearance and enable efficient transfer of a transfer material from the transfer layer to a receptor.

In an implementation, the pigment and the dye may be included in a total amount of 1 to 50% by weight, based on the solids content of the light-to-heat conversion layer. Within this content range, high light-to-heat conversion may occur in the light-to-heat conversion layer, enabling transfer of the transfer film. In an implementation, the pigment and the dye may be included in a total amount of 10 to 30% by weight.

The individual components of the light-to-heat conversion layer will now be explained in more detail.

Binder

The binder may act as a component for attaching the light-to-heat conversion layer to a base film and a transfer material. The transfer material may include an organic electroluminescent (EL) material. The binder may help to allow for transfer of the base film or the transfer material when the thermal transfer film is irradiated with light of a wavelength of 700 nm to 1,200 nm where the dye absorbs.

Various kinds of binder may be used. Binders that may be used in the light-to-heat conversion layer may include, e.g., phenolic resin, polyvinyl butyral resin, polyvinyl acetate resin, polyvinyl acetal resin, polyvinylidene chloride resin, cellulose ether resin, cellulose ester resin, nitrocellulose resin, polycarbonate resin, polyalkyl (meth)acrylate resin, epoxy (meth)acrylate resin, epoxy resin, urethane resin, ester resin, ether resin, alkyd resin, spiroacetal resin, polybutadiene resin, polythiol-polyene resin, (meth)acrylate resin of polyfunctional compounds such as polyhydric alcohols, and acrylic resin. These binder resins may be used alone or as a mixture of two or more thereof.

For example, the binder may be a mixture of polyalkyl (meth)acrylate and epoxy (meth)acrylate resin. The polyalkyl (meth)acrylate resin and the epoxy (meth)acrylate resin may be included in amounts of 30 to 70% by weight. Within these ranges, light energy may be efficiently converted to thermal energy, achieving satisfactory heat transfer. For example, the polyalkyl (meth)acrylate resin and the epoxy (meth)acrylate resin may be included in amounts of 40 to 60% by weight.

For example, the binder may include an acrylic binder. The acrylic binder may be, e.g., a UV curable resin, a polyfunctional monomer, or a mixture thereof. The acrylic binder may be a UV curable resin or a polyfunctional (meth)acrylate monomer.

The UV curable resin may be, e.g., a water soluble (meth) acrylic copolymer. The UV curable resin may be one having (meth)acrylate groups, for example, a urethane resin, an ester resin, an ether resin, an acrylic resin, an alkyd resin, a spiroacetal resin, a polybutadiene resin, a polythiol-polyene resin, or a (meth)acrylate resin of a polyfunctional compound such as a polyhydric alcohol.

UV curable resins that may be used as the acrylic binder may include, e.g., ethylene glycol di(meth)acrylate, neopentyl glycol di(meth)acrylate, 1,6-hexanediol (meth)acrylate, trimethylolpropane tri(meth)acrylate, dipentaerythritol hexa (meth)acrylate, polyol poly(meth)acrylate, di(meth)acrylate of bisphenol A diglycidyl ether, polyester (meth)acrylate obtained by esterification of polyhydric alcohol, polyhydric carboxylic acid and acrylic acid, polysiloxane polyacrylate, urethane (meth)acrylate, pentaerythritol tetra(meth)acrylate, and glycerin tri(meth)acrylate. These UV curable resins may be used alone or as a mixture of two or more thereof.

The polyfunctional monomer may have two or more functional groups, e.g., six or more functional groups. For example, the polyfunctional monomer may include polyfunctional (meth)acrylate monomers, fluorinated polyfunctional (meth)acrylate monomers, and mixtures thereof.

Polyfunctional monomers that may be used as the acrylic binder may include, e.g., polyfunctional (meth)acrylate monomers, such as ethylene glycol di(meth)acrylate, diethylene glycol di(meth)acrylate, triethylene glycol di(meth) acrylate, 1,4-butanediol di(meth)acrylate, 1,6-hexanediol di(meth)acrylate, neopentyl di(meth)acrylate, pentaerythritol di(meth)acrylate, pentaerythritol tri(meth)acrylate, dipentaerythritol di(meth)acrylate, dipentaerythritol tri(meth) acrylate, dipentaerythritol penta(meth)acrylate, pentaerythritol hexa(meth)acrylate, dipentaerythritol hexa(meth) acrylate, bisphenol A di(meth)acrylate, trimethylolpropane tri(meth)acrylate, trimethylolpropane penta(meth)acrylate, trimethylolpropane hexa(meth)acrylate, novolac epoxy (meth)acrylate, propylene glycol di(meth)acrylate, 1,4-butanediol di(meth)acrylate and 1,6-hexanediol di(meth)acrylate; and fluorinated products thereof. These polyfunctional (meth)acrylate monomers may be used alone or as a mixture of two or more thereof.

In an example embodiment, 50% or more by weight of the binder may be thermally decomposed at 450° C. In this case, thermal swelling of the light-to-heat conversion layer takes place, facilitating transfer of the transfer material to a receptor.

The binder may be included in an amount of, e.g., 90 to 99.9% by weight, based on the solids content of the light-to-heat conversion layer. The content of the binder may be from 90 to 99% by weight. In the case where both the pigment and the dye are included in the light-to-heat conversion layer, the binder may be included in an amount of 50 to 99% by weight, based on the solids content of the light-to-heat conversion layer.

The acrylic binder may be included in an amount of 50 to 99% by weight, based on the solids content of the light-to-heat conversion layer. Within this content range, the acrylic binder may form a stable matrix of the light-to-heat conversion layer. In an implementation, the content of the acrylic binder may be from 85 to 90% by weight. The UV curable resin and the polyfunctional monomer may be included in a weight ratio of 1:0.1 to 1:1.5 in the acrylic binder. The weight ratio of the UV curable resin to the polyfunctional monomer may be, e.g., from 1:0.5 to 1:1.0.

Dye

The dye included in the light-to-heat conversion layer of the thermal transfer film may include a near-infrared absorbing dye. The near-infrared absorbing dye may interact with the binder in the light-to-heat conversion layer and absorb light of a particular wavelength to convert the light to heat.

The near-infrared absorbing dye may be advantageous in terms of uniformity compared to pigments such as those including nanoscale carbon black, and may thus improve the coating uniformity of the light-to-heat conversion layer, which may increase the transfer efficiency of a transfer material in the light-to-heat conversion layer.

When another dye is added, e.g., to achieve a desired OD value, the near-infrared absorbing dye may precipitate, e.g., due to low solubility. The use of a mixture of the pigment and the dye for a desired OD value may reduce the amount of the dye that is added, compared to the use of the dye only for the same OD value. Thus, dye precipitation may be reduced or prevented, which may help ensure uniform OD values and good appearance of the light-to-heat conversion layer. Irradiation with a laser of a particular wavelength may allow the light-to-heat conversion layer to have uniform OD values, together with good appearance, leading to high transfer efficiency of the thermal transfer film.

The near-infrared absorbing dye may absorb infrared light in the wavelength band of 700 nm to 1,200 nm. The near-infrared absorbing dye may be, e.g., a dye selected from the group of diimmonium dyes, metal complex dyes, naphthalocyanine dyes, phthalocyanine dyes, polymethine dyes, anthraquinone dyes, porphyrin dyes, metal complex type cyanine dyes, and mixtures thereof.

In an example embodiment, the near-infrared absorbing dye may be a diimmonium dye represented by Formula 1:

Formula 1

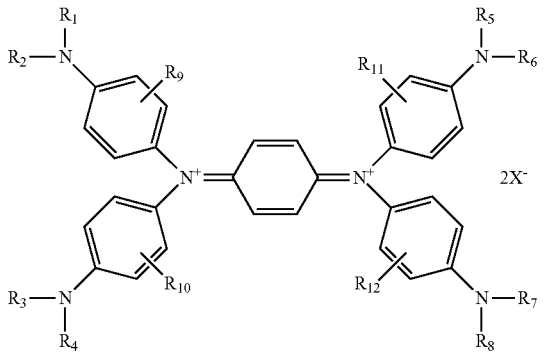

In Formula 1, $R_1$ to $R_{12}$ may each independently be a hydrogen atom, a halogen atom, a substituted or unsubstituted $C_1$-$C_{16}$ alkyl group, or a substituted or unsubstituted $C_1$-$C_{16}$ aryl or heteroaryl group, and X may be a monovalent or divalent organic anion or a monovalent or divalent inorganic acid anion;

In an example embodiment, the near-infrared absorbing dye may be a phthalocyanine dye represented by Formula 2:

Formula 2

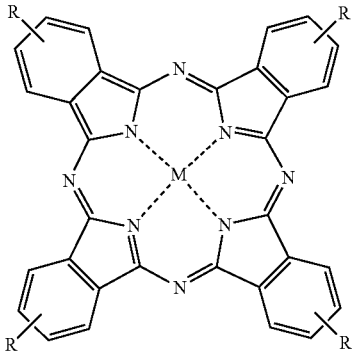

In Formula 2, each R may independently be a hydrogen atom, a halogen atom, a substituted or unsubstituted $C_1$-$C_{16}$ alkyl group, a substituted or unsubstituted $C_1$-$C_{12}$ aryl or heteroaryl group, a substituted or unsubstituted phenyl group, a substituted or unsubstituted $C_1$-$C_5$ alkoxy group, a substituted or unsubstituted allyloxy group, a $C_1$-$C_5$ alkoxy group substituted with at least one fluorine atom, or a substituted or unsubstituted five-membered ring containing at least one nitrogen atom, and M may represent two hydrogen atoms, a divalent, trivalent, or tetravalent substituted metal atom, or an oxymetal atom;

In an example embodiment, the near-infrared absorbing dye may be a naphthalocyanine dye represented by Formula 3:

Formula 3

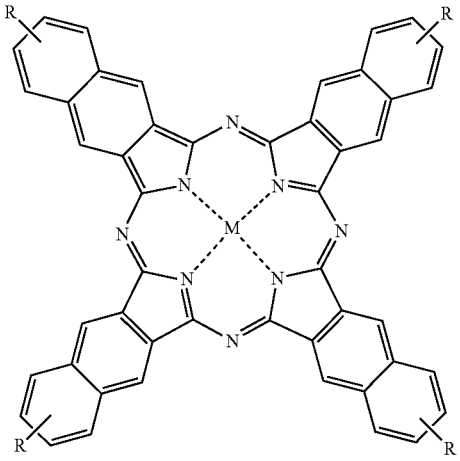

In Formula 3, each R may independently be a hydrogen atom, a halogen atom, a substituted or unsubstituted $C_1$-$C_{16}$ alkyl group, a substituted or unsubstituted $C_1$-$C_{12}$ aryl or heteroaryl group, a substituted or unsubstituted phenyl group, a substituted or unsubstituted $C_1$-$C_5$ alkoxy group, a substituted or unsubstituted allyloxy group, a $C_1$-$C_5$ alkoxy group substituted with at least one fluorine atom, or a substituted or unsubstituted five-membered ring containing at least one nitrogen atom, and M may represent two hydrogen atoms, a divalent, trivalent, or tetravalent substituted metal atom, or an oxymetal atom;

In an example embodiment, the near-infrared absorbing dye may be a metal complex dye represented by Formula 4:

Formula 4

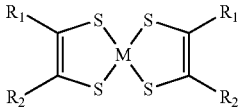

In Formula 4, $R_1$ and $R_2$ may each independently be a hydrogen atom, a $C_1$-$C_{16}$ alkyl group, a $C_1$-$C_{16}$ aryl group, a $C_1$-$C_{16}$ alkoxy group, a $C_1$-$C_{16}$ alkylamino group, a $C_1$-$C_{16}$ arylamino group, a $C_1$-$C_{16}$ alkylthio group, a $C_1$-$C_{16}$ arylthio group, a phenoxy group, a hydroxyl group, a trifluoromethyl group, a nitro group, a cyano group, a halo group, a phenyl group, or a naphthyl group, and M may represent two hydrogen atoms, a divalent, trivalent, or tetravalent substituted metal atom or an oxymetal atom;

In an example embodiment, the near-infrared absorbing dye may be a metal complex dye represented by Formula 5:

Formula 5

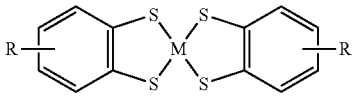

In Formula 5, each R may independently be a hydrogen atom, a $C_1$-$C_{16}$ alkyl group, a $C_1$-$C_{16}$ aryl group, a $C_1$-$C_{16}$ alkoxy group, a $C_1$-$C_{16}$ alkylamino group, a $C_1$-$C_{16}$ arylamino group, a $C_1$-$C_{16}$ alkylthio group, a $C_1$-$C_{16}$ arylthio group, a phenoxy group, a hydroxyl group, a trifluoromethyl group, a nitro group, a cyano group, a halo group, a phenyl group, or a naphthyl group, and M may represent two hydrogen atoms, a divalent, trivalent, or tetravalent substituted metal atom, or an oxymetal atom.

In an example embodiment, the near-infrared absorbing dye may include one or more of the above Formulae 1-5.

In an example embodiment, $R_1$ to $R_{12}$ in Formula 1 are each independently a hydrogen atom, a halogen atom, or a substituted or unsubstituted $C_1$-$C_{12}$ alkyl, aryl, or heteroaryl group.

In an example embodiment, each R in Formulae 2 and 3 is independently a hydrogen atom, a halogen atom, or a substituted or unsubstituted $C_1$-$C_{12}$ alkyl, aryl, or heteroaryl group.

The monovalent or divalent organic anion in Formula 1 may be, e.g., an organic carboxylic acid anion, an organic sulfonic acid anion, an organic boric acid ion, or an organometallic anion. The organic carboxylic acid anion may be, e.g., an acetate anion, a lactate anion, a trifluoroacetate anion, a propionate anion, a benzoate anion, an oxalate anion, a succinate anion, or a stearate anion. The organic sulfonic acid anion may be, e.g., a methanesulfonate anion, a toluenesulfonate anion, a naphthalenemonosulfonate anion, a chlorobenzenesulfonate anion, a nitrobenzenesulfonate anion, a dodecylbenzenesulfonate anion, a benzenesulfonate anion, an ethanesulfonate anion, a trifluoromethanesulfonate anion, a bis(trifluoromethanesulfonyl)imidic acid anion, or a tris (trifluoromethanesulfonyl)imidic acid anion. The organic boric acid anion may be, e.g., a tetraphenylborate anion or a butyltriphenylborate anion.

Various kinds of the monovalent or divalent inorganic acid anion may be used in Formula 1. For example, the monovalent inorganic acid anion may be a halide anion, such as fluoride anion, a chloride anion, a bromide anion, or an iodide anion, a thiocyanate anion, a hexafluoroantimonate anion, a perchlorate anion, a periodate anion, a nitrate anion, a tetrafluoroborate anion, a hexafluorophosphate anion, a molybdate anion, a tungstate anion, a titanate anion, a vanadate anion, a phosphate anion, or a borate anion. The divalent inorganic acid anion may be, e.g., a naphthalene-1,5-disulfonate anion or a naphthalene-1,6-disulfonate anion.

In an example embodiment, X in Formula 1 is an organic sulfonic acid anion, a hexafluoroantimonate anion, a tetrafluoroborate anion, a hexafluorophosphate anion, a tungstate anion, a phosphate anion, or a borate anion.

Each of the substituents in Formulae 1-3 may be, e.g., a halogen atom, a $C_1$-$C_6$ alkyl group, a $C_1$-$C_6$ alkoxy group, a $C_6$-$C_{10}$ aryl group, or a $C_6$-$C_{10}$ heteroaryl group.

In an example embodiment, the dye is selected from the group of metal complex dyes, phthalocyanine dyes, diimmonium dyes, and mixtures thereof.

The dye may be included in an amount of 0.1 to 10% by weight, based on the solids content of the light-to-heat conversion layer. Within this content range, the light-to-heat conversion layer may have a uniform appearance and may exhibit the desired OD values. The content of the dye may be, e.g., from 0.5 to 10% by weight.

In the case where both the dye and the pigment are included in the light-to-heat conversion layer, the dye may be included in an amount of 0.5 to 29.5% by weight, based on the solids content of the light-to-heat conversion layer. Within this content range, light may be efficiently converted to heat in the light-to-heat conversion layer light to enable transfer of the transfer film. The content of the dye may be, e.g., from 5 to 20% by weight.

The dye and the pigment may be included in a specific ratio in the light-to-heat conversion layer. For example, the pigment and the dye may be included in a weight ratio ranging from 1:0.1 to 1:9. Within this range, the degree of dispersion of the pigment and the solubility of the dye may be improved simultaneously. The weight ratio of the pigment to the dye may be, e.g., from 1:0.2 to 1:1.8.

Pigment

When the pigment is dispersed in the light-to-heat conversion layer of the thermal transfer film, the pigment molecules may tend to aggregate. This aggregation tendency may be proportional to the content of the pigment. The use of a mixture of the pigment and the dye for the desired OD values may reduce the amount of the pigment added (for the same OD values) when compared to the amount of pigment used when only pigment is used. Thus, the pigment aggregation may be reduced or prevented, which may enable more uniform dispersion of the pigment. Irradiation with a laser of a particular wavelength may allow the light-to-heat conversion layer to have uniform OD values, together with good appearance, which may lead to high transfer efficiency of the thermal transfer film.

The pigment may be, e.g., a pigment selected from the group of carbon black pigments, metal oxide pigments, metal sulfide pigments, graphite pigments, and mixtures thereof.

In the case where both the dye and the pigment are included in the light-to-heat conversion layer, the pigment may be included in an amount of 0.5 to 29.5% by weight, based on the solids content of the light-to-heat conversion layer. Within this content range, irradiation of a laser of a particular wavelength may enable transfer of the transfer film. The content of the pigment may be, e.g., from 5 to 20% by weight.

The light-to-heat conversion layer of the thermal transfer film may include one or more additives, e.g., an additive selected from the group of an ionic liquid, a photoinitiator, and a dispersant.

Ionic Liquid

The ionic liquid may be included in the light-to-heat conversion layer of the thermal transfer film to stabilize the binder, the dye, and/or the pigment. The stabilization effects of the ionic liquid may be particularly exhibited when an acrylic binder having hydroxyl groups is included in the light-to-heat conversion layer.

The ionic liquid may be a liquid salt at room temperature and may be composed of an anion and a cation. The ionic liquid may decrease degradation of the near-infrared absorbing dye, particularly a diimmonium dye. In the case where the anion of the diimmonium dye is the same as the anion of the ionic liquid, the heat resistance of the light-to-heat conversion layer may be enhanced.

The anion of the ionic liquid may be, e.g., $Br^-$, $Cl^-$, $I^-$, $BF_4^-$, $PF_6^-$, $ClO_4^-$, $NO_3^-$, $AlCl_4^-$, $Al_2Cl_7^-$, $AsF_6^-$, $SbF_6^-$, $CH_3COO^-$, $CF_3COO^-$, $CH_3SO_3^-$, $C_2H_5SO_3^-$, $CH_3SO_4^-$, $C_2H_5SO_4^-$, $CF_3SO_3^-$, $(CF_3SO_2)_2N^-$, $(CF_3SO_2)_3C^-$, $(CF_3CF_2SO_2)_2N^-$, $C_4F_9SO_3^-$, $C_3F_7COO^-$, or $(CF_3SO_2)(CF_3CO)N^-$.

The cation of the ionic liquid may be, e.g., a cation having a heteroaromatic functional group such as a substituted or unsubstituted $C_4$-$C_{20}$ imidazolium or a substituted or unsubstituted $C_4$-$C_{20}$ pyridinium cation, a $C_1$-$C_{20}$ aliphatic ammonium cation, or $C_6$-$C_{20}$ alicyclic ammonium cation.

Ionic liquids that may be used in the light-to-heat conversion layer may include, e.g., N-n-butyl-3-methylpyridinium bis(trifluoromethanesulfonyl)imide, N,N,N-trimethyl-N-propylammonium bis(trifluoromethanesulfonyl)imide, 1-ethyl-3-methylimidazolium tetrafluoroborate, and 1-allyl-3-ethylimidazolium bromide.

The ionic liquid may be included in an amount of 0.1 to 70 parts by weight, based on 100 parts by weight (solids content) of the light-to-heat conversion layer. Within this content range, the ionic liquid may stabilize the binder, the dye, or the pigment. The content of the ionic liquid may be from 0.1 to 50 parts by weight, e.g., 0.1 to 30 parts by weight or 5 to 20 parts by weight.

Photoinitiator

When the light-to-heat conversion layer is irradiated with UV, the photoinitiator may induce curing of the binder to increase the hardness of the thermal transfer film.

The photoinitiator may include, e.g., a benzophenone compound such as 1-hydroxycyclohexyl phenyl ketone.

The photoinitiator may be included in an amount of 0.01 to 10 parts by weight, based on 100 parts by weight (solids content) of the light-to-heat conversion layer. Within this content range, sufficient hardness of the thermal transfer film may be obtained and the initiator may not remain unreacted as an impurity (unreacted initiator may deteriorate the hardness of the light-to-heat conversion layer). The content of the photoinitiator may be from 0.01 to 3 parts by weight, e.g., from 0.1 to 1 part by weight or from 0.1 to 0.5 parts by weight.

Dispersant

The dispersant may be included in the light-to-heat conversion layer of the thermal transfer film to increase the degree of dispersion of the pigment or the dye.

The dispersant may including, e.g., a conductive polymer selected from the group of polyaniline, polythiophene, polypyrrole and derivatives thereof; a semi-conductive polymer selected from the group of polyphenylene, poly(phenylene vinylene), polyfluorene, poly(3,4-disubstituted thiophene), polybenzothiophene, polyisothianaphthene, polypyrrol, polyfuran, polypyridine, poly-1,3,4-oxadiazole, polyazulene, polyselenophene, polybenzofuran, polyindole, polypyridazine, polypyrene, polyarylamine and derivatives thereof; or a polyvinyl acetate or a copolymer thereof.

The dispersant may be included in an amount of 0.01 to 3 parts by weight, based on 100 parts by weight (solids content)

of the light-to-heat conversion layer. The content of the dispersant may be, e.g., from 0.1 to 1 part by weight.

The light-to-heat conversion layer may have a thickness of 1 to 10 μm. Within this thickness range, efficient thermal transfer may be enabled. The thickness of the light-to-heat conversion layer may be, e.g., 2 to 5 μm.

Figure 2:
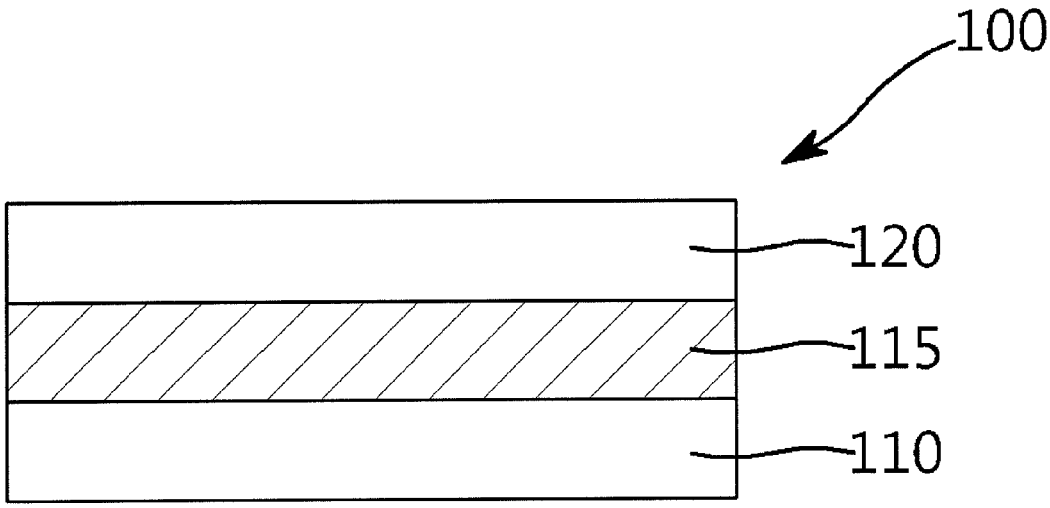

FIG. 2 illustrates a sectional view of a thermal transfer film according to an embodiment. Referring to FIG. 2, the thermal transfer film 100 may have a structure in which the light-to-heat conversion layer 115 is laminated on a base film 110 and a transfer layer 120 is laminated on the light-to-heat conversion layer 115. The transfer layer 115 may include a transfer material including an organic electroluminescent (EL) material. When the light-to-heat conversion layer 115 is irradiated with a laser of a particular wavelength in a state in which the transfer layer 115 is in contact with the surface of a receptor having a specific pattern, the light-to-heat conversion layer 115 may absorb light energy to generate heat, which may swell the light-to-heat conversion layer to thermally transfer the transfer material from the transfer layer to the receptor so as to correspond to the pattern of the receptor.

The base film may be a film that has good adhesion to the adjacent light-to-heat conversion layer. The base film may control heat transfer between the light-to-heat conversion layer and other layers. The base film may be transparent. For example, the base film may be a transparent polymer film selected from the group of polyester films, polyacrylic films, polyepoxy films, polyethylene films, polypropylene films, polystyrene films, and combinations thereof. In an example embodiment, a polyester film, a polyethylene terephthalate film, or a polyethylene naphthalate film may be used as the base film.

The base film may have a thickness of 10 to 500 μm. The thickness of the base film may be, e.g., from 30 to 500 μm or 40 to 100 μm.

The transfer layer may include one or more layers to transfer the transfer material to a receptor. The additional layers may be formed using, e.g., organic materials, inorganic materials, organometallic materials, and other materials. These materials may include electroluminescent materials and electrically active materials.

The transfer layer may be uniformly coated on the light-to-heat conversion layer, e.g., by evaporation, sputtering, or solvent coating. In an implementation, the transfer layer may be patterned on the light-to-heat conversion layer by digital printing, lithography printing, evaporation, or sputtering through a mask.

Figure 3:
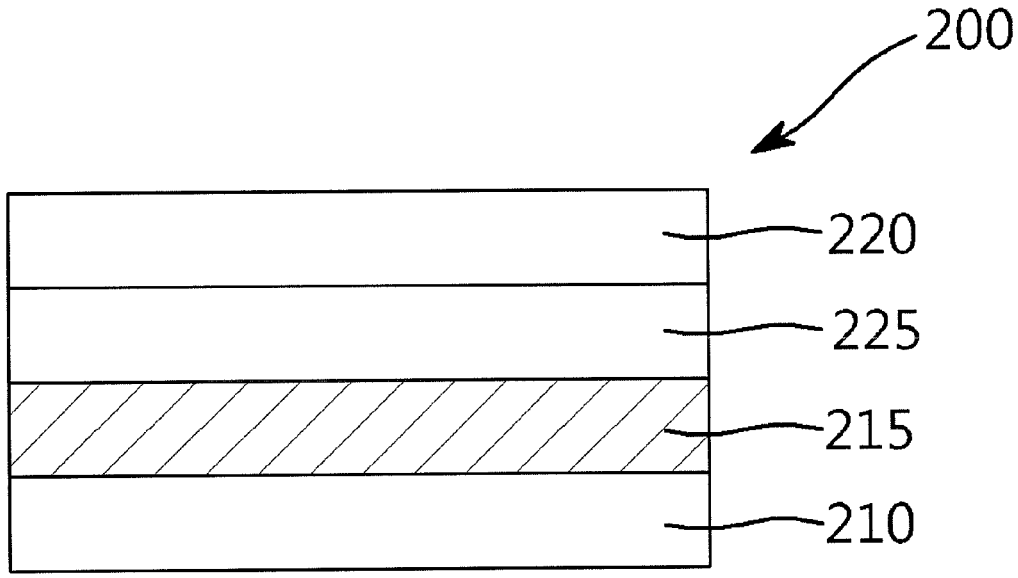

FIG. 3 illustrates a sectional view of a thermal transfer film according to an embodiment. Referring to FIG. 3, a thermal transfer film 200 may include a base film 210, a light-to-heat conversion layer 215 laminated on the base film 210, an interlayer 225 laminated on the light-to-heat conversion layer 215, and a transfer layer 220 laminated on the interlayer 225. The thermal transfer film 200 may further include an interlayer 225 laminated between the light-to-heat conversion layer 215 and the transfer layer 220. The interlayer 225 may be used to minimize damage to and contamination of the transfer material of the transfer layer 220, and may help protect the transfer material of the transfer layer from distortion. The interlayer 225 may help improve adhesion of the transfer layer 220 to the light-to-heat conversion layer 215, and may control the transfer of the transfer layer 215 to a patterned portion and a non-patterned portion in a receptor.

The interlayer may include, e.g., a polymer film, a metal layer, an inorganic layer, and an organic/inorganic composite layer. For example, the inorganic layer may be a layer obtained by sol-gel deposition or vapor deposition of an inorganic oxide, such as silica, Titania or a metal oxide. Organic materials for the interlayer may include both thermosetting and thermoplastic materials.

The following Examples and Comparative Examples are provided in order to highlight characteristics of one or more embodiments, but it will be understood that the Examples and Comparative Examples are not to be construed as limiting the scope of the embodiments, nor are the Comparative Examples to be construed as being outside the scope of the embodiments. Further, it will be understood that the embodiments are not limited to the particular details described in the Examples and Comparative Examples.

Details of components used in Examples 1-4 and Comparative Examples 1-3 are as follows:

(1) Binders: Polymethyl methacrylate, bisphenol A epoxy acrylate, and acrylic binders were used. A water soluble acrylic copolymer (Elvacite 2669, Sartomer) and trimethylolpropane hexaacrylate (SR341, Sartomer), a hexafunctional monomer, were used as the acrylic binders.

(2) Dyes: A metal complex near-infrared absorbing dye (NIR-885DTN, KISCO) and a diimmonium-based near-infrared absorbing dye (CIR1081, Japan Carlit Co.) were used.

(3) Pigment: A carbon black pigment (050, SAKATA) was used.

(4) Base film: A 75 μm thick polyethylene terephthalate (PET) film (A4300, Toyobo) was used.

EXAMPLE 1

45 parts by weight of the polymethyl methacrylate and 45 parts by weight of the bisphenol A epoxy acrylate were mixed to prepare a binder mixture. 10 parts by weight of the metal complex dye were added to the binder mixture, followed by mixing for 30 min to prepare a composition. The composition was bar-coated on the base film and dried at 80° C. for 2 min to form a 2.5 μm thick light-to-heat conversion layer, completing the production of a thermal transfer film.

EXAMPLE 2

A thermal transfer film was produced in the same manner as in Example 1, except that the diimmonium dye was used instead of the metal complex dye.

EXAMPLE 3

50 parts by weight of the water soluble acrylic polymer, 40 parts by weight of the polyfunctional monomer, 7 parts by weight of the pigment, and 3 parts by weight of the diimmonium dye were mixed together to prepare a composition. The amount of each component is based on the solids content of the composition. The composition was bar-coated on the base film, dried at 80° C. for 2 min, and cured at 350 mJ/cm$^2$ to form a 2.5 μm thick light-to-heat conversion layer.

EXAMPLE 4

50 parts by weight of the water soluble acrylic polymer, 40 parts by weight the of polyfunctional monomer, 5 parts by weight of the pigment, and 5 parts by weight of the diimmonium dye were mixed together to prepare a composition. The amount of each component is based on the solids content of the composition. The composition was bar-coated on the base film, dried at 80° C. for 2 min, and cured at 350 mJ/cm$^2$ to form a 2.5 μm thick light-to-heat conversion layer.

COMPARATIVE EXAMPLE 1

A thermal transfer film was produced in the same manner as in Example 1, except that a visible light-absorbing porphyrin dye (SK-d583, SK Chemical) was used instead of the metal complex dye. The thermal transfer film had the same thickness as the thermal transfer film of Example 1.

COMPARATIVE EXAMPLE 2

A thermal transfer film was produced in the same manner as in Example 1, except that the carbon black pigment was used instead of the metal complex dye. The thermal transfer film had the same thickness as the thermal transfer film of Example 1.

COMPARATIVE EXAMPLE 3

50 parts by weight of the water soluble acrylic polymer, 40 parts by weight of the polyfunctional monomer, and 10 parts by weight of the pigment were mixed together to prepare a composition. The amount of each component is based on the solids content of the composition. The composition was bar-coated on the base film, dried at 80° C. for 2 min, and cured at 350 mJ/cm$^2$ to form a 2.5 μm thick light-to-heat conversion layer.

EXPERIMENTAL EXAMPLE 1

Evaluation of Physical Properties of the Thermal Transfer Films

The thermal transfer films produced in Examples 1-2 and Comparative Examples 1-2 were evaluated for the physical properties shown in Table 1 by the following methods. The results are also shown in Table 1.

(1) Optical density (OD): The absorbance of each of the thermal transfer films was measured at 970 nm using a UV-VIS spectrometer (Perkin Elmer Lambda 950).

(2) Appearance: The appearance of each of the light-to-heat conversion layers of the thermal transfer films was observed using an optical microscope (ECLIPSE L150, Nikon). The appearance of the light-to-heat conversion layer was judged to be "good" when no spots and surface abnormalities were observed, and judged to be "poor" when spots and surface abnormalities were observed.

TABLE 1

| | Example 1 | Example 2 | Comparative Example 1 | Comparative Example 2 |
|---|---|---|---|---|
| OD (at 970 nm) | 1.2 | 1.4 | 0.8 | 0.7 |
| Appearance | Good | Good | Good | Poor |

As may be seen from the absorbance values (at 970 nm) shown in Table 1, the thermal transfer films of Examples 1 and 2 had OD values within the desired range of 1.0 to 1.5 for thermal transfer. In addition, the thermal transfer films of Examples 1 and 2 had good appearances. In contrast, the OD values of the thermal transfer film of Comparative Example 1, which was produced using the visible light-absorbing dye, and the thermal transfer film of Comparative Example 2, which was produced using the pigment only, did not reach the desired range. The thermal transfer film of Comparative Example 2 had poor appearance.

EXPERIMENTAL EXAMPLE 2

Evaluation of Physical Properties of the Thermal Transfer Films

The thermal transfer films produced in Examples 1, 3, and 4 and Comparative Example 3 were evaluated for the physical properties shown in Table 2 by the following methods. The results are also shown in Table 2.

(1) Optical density (OD) values: The absorbance of each of the thermal transfer films was measured at 1,064 nm using a UV-VIS spectrometer (Perkin Elmer Lambda 950). For determination of OD variation, the OD measurement was repeated ten times or more.

(2) OD variation (ΔOD): Ten of the OD values were randomly selected. The difference between the maximum and minimum OD values was calculated.

(3) Appearance: The appearance of each of the light-to-heat conversion layers of the thermal transfer films was observed using an optical microscope (ECLIPSE L150, Nikon). The appearance of the light-to-heat conversion layer was evaluated according to the following criteria:

Good: No spots were detected in the appearance of the light-to-heat conversion layer and no dye precipitation was observed Poor: Spots were detected in the appearance of the light-to-heat conversion layer and dye precipitation was observed

TABLE 2

| | Optical Densities (OD) | | | | | | | | | | | |
|---|---|---|---|---|---|---|---|---|---|---|---|---|
| | 1 | 2 | 3 | 4 | 5 | 6 | 7 | 8 | 9 | 10 | ΔOD | Appearance |
| Example 1 | 1.21 | 1.17 | 1.23 | 1.24 | 1.26 | 1.22 | 1.21 | 1.25 | 1.16 | 1.19 | 0.10 | Good |
| Example 3 | 1.50 | 1.50 | 1.48 | 1.50 | 1.48 | 1.49 | 1.50 | 1.49 | 1.50 | 1.48 | 0.02 | Good |
| Example 4 | 1.48 | 1.43 | 1.50 | 1.48 | 1.46 | 1.49 | 1.45 | 1.49 | 1.42 | 1.42 | 0.08 | Good |
| Comparative Example 3 | 1.01 | 1.63 | 0.72 | 0.76 | 0.61 | 0.79 | 1.31 | 0.92 | 0.86 | 0.89 | 1.02 | Poor |

As may be seen from the results in Table 2, the thermal transfer film of Example 1, which was produced using the dye, had a uniform OD variation of less than 1, and less than 0.5. The thermal transfer films of Examples 3 and 4, each of which was produced using both the dye and the pigment, had uniform OD variations of less than 1, and less than 0.1, which are lower than the OD variation of the thermal transfer film of Example 1. In addition, the light-to-heat conversion layers of the thermal transfer films of Examples 3 and 4 had good appearances. Furthermore, no spots were detected and no dye precipitation was observed in the light-to-heat conversion layers. In contrast, dispersion of the pigment was not satisfactory in the thermal transfer film of Comparative Example 3, which included no dye. As a result, the OD values of the thermal transfer film were not uniform. Further, spots were detected on the surface of the light-to-heat conversion layer of the thermal transfer film.

By way of summation and review, laser induced thermal imaging using a light-to-heat conversion layer may be used for forming a pattern. According to this method, light at a particular wavelength may be absorbed and converted to heat in a light-to-heat conversion layer to allow the transfer of a transfer material laminated on the light-to-heat conversion layer to a receptor. When a fluorescent dye, a radiation-polarizing dye, a pigment, or a metal absorbs light at a particular wavelength in a general light-to-heat conversion layer, the light energy is converted to thermal energy, which affects a binder included in the light-to-heat conversion layer to allow for the transfer of a transfer material. If the dye and the pigment have a strong tendency to aggregate, then portions of the light to-heat conversion layer may not absorb light, which may not provide uniform transfer of all wanted portions and may not provide a uniform coating layer.

A pigment may be used alone as a light-to-heat conversion material in a light-to-heat conversion layer. However, low dispersion efficiency of a pigment (for example, carbon black) included in a light-to-heat conversion layer may make it difficult to obtain uniform OD values over the entire region of a thermal transfer film. This may limit the effectiveness in transferring a transfer material of a transfer layer to a receptor.

If the light-to-heat conversion layer in contact with the transfer layer has a uniform surface and to uniformly absorbs light in a specific wavelength range, better transfer of the transfer material from the transfer layer to the receptor may be obtained. Thus, a light-to-heat conversion layer that has high transfer efficiency, uniform, high OD values for light at a particular wavelength, a small thickness, and appearance sufficient to ensure uniformity of a coating layer, and a thermal transfer film including the light-to-heat conversion layer, are desired. As described above, embodiments may provide a thermal transfer film including a light-to-heat conversion layer and a transfer layer in which the light-to-heat conversion layer includes a binder and a dye, which may exhibit uniform optical density (OD) values with a small variation at a particular wavelength where the dye absorbs, together with good appearance, which may enable high transfer efficiency of a transfer material from the transfer layer to a receptor. Embodiments also relate to a thermal transfer film including a light-to-heat conversion layer and a transfer layer in which the light-to-heat conversion layer further includes a pigment, which may provide more uniform OD values with a smaller variation at a particular wavelength where the dye absorbs, together with good appearance, which may enable high transfer efficiency of a transfer material from a transfer layer to a receptor.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A thermal transfer film, comprising: a transfer layer on a light-to-heat conversion layer, the light-to-heat conversion layer including a dye and a binder, wherein the thermal transfer film has an optical density variation greater than or equal to 0 but smaller than 1.

2. The thermal transfer film as claimed in claim 1, wherein said thermal transfer film has an optical density variation greater than or equal to 0 but smaller than 0.5.

3. The thermal transfer film as claimed in claim 1, wherein said dye includes a near-infrared absorbing dye.

4. The thermal transfer film as claimed in claim 3, wherein said near-infrared absorbing dye absorbs light in the wavelength range of 700 nm to 1,200 nm.

5. The thermal transfer film as claimed in claim 4, wherein said dye includes at least one of a diimmonium dye, a metal complex dye, a naphthalocyanine dye, a phthalocyanine dye, a polymethine dye, an anthraquinone dye, a porphyrin dye, and a metal complex type cyanine dye.

6. The thermal transfer film as claimed in claim 1, wherein 50% or more by weight of the binder is thermally decomposed at 450° C.

7. The thermal transfer film as claimed in claim 1, wherein said binder includes at least one of a phenolic resin, a polyvinyl butyral resin, a polyvinyl acetate resin, a polyvinyl acetal resin, a polyvinylidene chloride resin, a polyacrylate resin, a cellulose ether resin, a cellulose ester resin, a nitrocellulose resin, a polycarbonate resin, a polyalkyl (meth) acrylate resin, an epoxy (meth)acrylate resin, an epoxy resin, a urethane resin, an ester resin, an ether resin, an alkyd resin, a spiroacetal resin, a polybutadiene resin, a polythiol-polyene resin, a (meth)acrylate resin of a polyhydric alcohol, and a (meth)acrylate resin of a polyfunctional acrylic resin.

8. The thermal transfer film as claimed in claim 1, wherein said dye and said binder are present in amounts of 0.1 to 10% by weight and 90 to 99.9% by weight, respectively, based on the solids content of the light-to-heat conversion layer.

9. The thermal transfer film as claimed in claim 1, wherein said light-to-heat conversion layer further comprises a pigment and has an optical density variation greater than or equal to 0 but smaller than 1 at a wavelength at which the dye absorbs in the range of 700 nm to 1,200 nm.

10. The thermal transfer film as claimed in claim 9, wherein said optical density variation is greater than or equal to 0 but smaller than 0.1.

11. The thermal transfer film as claimed in claim 9, wherein said light-to-heat conversion layer has optical density values of 1.0 to 5.0 at a wavelength at which the dye absorbs in the range of 700 nm to 1,200 nm.

12. The thermal transfer film as claimed in claim 9, wherein said pigment and said dye are present in a total amount of 1 to 50% by weight, based on the solids content of the light-to-heat conversion layer.

13. The thermal transfer film as claimed in claim 9, wherein said pigment and said dye are present in a weight ratio of 1:0.1 to 1:9.

14. The thermal transfer film as claimed in claim 9, wherein said pigment and said dye are present in amounts of 0.5 to 29.5% by weight, respectively, based on the solids content of the light-to-heat conversion layer.

15. The thermal transfer film as claimed in claim 9, wherein said pigment includes at least one of a carbon black pigment, a metal oxide pigment, a metal sulfide pigment, and a graphite pigment.

16. The thermal transfer film as claimed in claim 9, wherein said binder includes at least one of a UV curable resin and a polyfunctional monomer.

17. The thermal transfer film as claimed in claim 1, wherein said light-to-heat conversion layer has a thickness of 1 to 10 μm.

18. The thermal transfer film as claimed in claim 1, wherein said light-to-heat conversion layer further includes at least one additive of an ionic liquid, a photoinitiator, and a dispersant.

19. The thermal transfer film as claimed in claim 18, wherein said light-to-heat conversion layer includes said ionic liquid, and said ionic liquid includes:

at least one anion selected from the group of $Br^-$, $Cl^-$, $I^-$, $BF_4^-$, $PF_6^-$, $ClO_4^-$, $NO_3^-$, $AlCl_4^-$, $Al_2Cl_7^-$, $AsF_6^-$, $SbF_6^-$, $CH_3COO^-$, $CF_3COO^-$, $CH_3SO_3^-$, $C_2H_5SO_3^-$, $CH_3SO_4^-$, $C_2H_5SO_4^-$, $CF_3SO_3^-$, $(CF_3SO_2)_2N^-$, $(CF_3SO_2)_3C^-$, $(CF_3CF_2SO_2)_2N^-$, $C_4F_9SO_3^-$, $C_3F_7COO^-$, and $(CF_3SO_2)(CF_3CO)N^-$, and at least one cation selected from the group of a substituted or unsubstituted $C_4$-$C_{20}$ imidazolium, a substituted or unsubstituted $C_4$-$C_{20}$ pyridinium cation, a $C_1$-$C_{20}$ aliphatic ammonium cation, and a $C_6$-$C_{20}$ alicyclic ammonium cation.

20. The thermal transfer film as claimed in claim 18, wherein said light-to-heat conversion layer includes said ionic liquid, and said ionic liquid is present in an amount of 0.1 to 70 parts by weight, based on 100 parts by weight (solids content) of the light-to-heat conversion layer.

21. The thermal transfer film as claimed in claim 1, further comprising:

a base film, wherein the light-to-heat conversion layer is laminated on the base film, and the transfer layer is laminated on the light-to-heat conversion layer.

22. The thermal transfer film as claimed in claim 1, further comprising:

a base film, wherein the light-to-heat conversion layer is laminated on the base film, an interlayer is laminated on the light-to-heat conversion layer, and the transfer layer is laminated on the interlayer.

* * * * *